US008967249B2

(12) United States Patent
Akkurt et al.

(10) Patent No.: US 8,967,249 B2
(45) Date of Patent: Mar. 3, 2015

(54) RESERVOIR AND COMPLETION QUALITY ASSESSMENT IN UNCONVENTIONAL (SHALE GAS) WELLS WITHOUT LOGS OR CORE

(75) Inventors: Ridvan Akkurt, Lexington, MA (US); Romain Charles Andre Prioul, Somerville, MA (US); Andrew E. Pomerantz, Lexington, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 297 days.

(21) Appl. No.: 13/447,109

(22) Filed: Apr. 13, 2012

(65) Prior Publication Data

US 2013/0270011 A1 Oct. 17, 2013

(51) Int. Cl.
*E21B 49/00* (2006.01)

(52) U.S. Cl.
USPC ..... 166/250.02; 166/264; 175/50

(58) Field of Classification Search
USPC ..... 166/264, 252.5, 250.02; 175/50
See application file for complete search history.

(56) References Cited

U.S. PATENT DOCUMENTS

| | | | | |
|---|---|---|---|---|
| 4,765,182 | A * | 8/1988 | Boone | 73/152.04 |
| 4,914,591 | A | 4/1990 | Warren et al. | |
| 5,216,917 | A | 6/1993 | Detournay | |
| 5,519,214 | A | 5/1996 | Houwen et al. | |
| 5,670,711 | A | 9/1997 | Detournay et al. | |
| 7,379,819 | B2 | 5/2008 | Betancourt et al. | |
| 8,374,836 | B2 * | 2/2013 | Yogeswaren | 703/10 |
| 8,573,298 | B2 * | 11/2013 | Jacobi et al. | 166/254.2 |
| 2007/0137293 | A1 | 6/2007 | Pop et al. | |
| 2011/0017458 | A1 * | 1/2011 | East et al. | 166/308.1 |
| 2011/0022320 | A1 | 1/2011 | Abousleiman et al. | |
| 2011/0048700 | A1 | 3/2011 | Van Zuilekom et al. | |
| 2012/0179444 | A1 | 7/2012 | Ganguly et al. | |
| 2012/0185225 | A1 | 7/2012 | Onda et al. | |
| 2013/0046469 | A1 | 2/2013 | Herron et al. | |
| 2013/0273661 | A1 * | 10/2013 | Pomerantz | 436/29 |
| 2014/0020954 | A1 * | 1/2014 | Pelletier et al. | 175/50 |

FOREIGN PATENT DOCUMENTS

WO 20101043851 4/2010

OTHER PUBLICATIONS

Camron Miller, George Waters and Erik Rylander, "Evaluation of Production Log Data from Horizontal Wells Drilled in Organic Shales," SPE144326.

T. Loermans, et al., Results from Pilot Tests Prove the Potential of Advanced Mud Logging, 2011 SPE149134.

A.A. Daneshy, et al., "In-Situ Stress Measurements During Drilling,"Journal of Petroleum Technology, Aug. 1986, SPE 13227.

K.R.. Kunze, et al, "Accurate In-Situ Stress Measurements During Drilling Operations," SPE 24593, 1992.

(Continued)

*Primary Examiner* — Kenneth L Thompson
(74) *Attorney, Agent, or Firm* — Stephanie Chi

(57) ABSTRACT

Embodiments herein relate to a method for recovering hydrocarbons from a formation including collecting and analyzing a formation sample, drilling operation data, and wellbore pressure measurement, estimating a reservoir and completion quality, and performing an oil field service in a region of the formation comprising the quality. In some embodiments, the formation sample is a solid collected from the drilling operation or includes cuttings or a core sample.

29 Claims, 9 Drawing Sheets

(56) References Cited

OTHER PUBLICATIONS

D. McKinney, et al, "Advanced Mud Gas Logging in Combination with Wireline Formation Testing and Geochemical Fingerprinting for an Improved Understanding of Reservoir Architecture," SPE Annual Technical conference and Exhibition, Nov. 11-14, 2007, Anaheim, California, U.S.A., SPE 109861.
S. Brunauer, et al, "Adsorption of Gases in Multimolecular Layers," Journal of the American Chemical Society, 1938, 60, 309-319.
F.J. Santarelli, et al, "Formation Evaluation from Logging on Cuttings," spe Reservoir Evaluation & Engineering, Jun. 1998, SPE 36851, pp. 238-244.
O.M. Nes, et al, "RigSite and Laboratory Use of CWT Acoustic Velocity Measurements on Cuttings," SPE Reservoir Evaluation & Engineering, Jun. 1998, SPE 50982.
C.M. Sayers, "The effect of low aspect ratio pores on the seismic anisotropy of shales," SEG Expanded Abstracts 27, 2750, 2008.
J. Sarout, et al., "Anisotropy of elastic wave velocities in deformed shales: Part 1—Experimental results," Geophysics 73, D75 2008.
J. Sarout, et al., "Anisotropy of elastic wave velocities in deformed shales: Part 2—Modeling results," Geophysics, 73 D91, 2008.
J. A. Ortega, "Microporomechanical modeling of shale" , at http://dspace.mit.edu/handle/1721.1/57784, PhD, MIT.
J.A. Ortega, et al, The nanogranular acoustic signature of share, Geophysics 74 D65 2009.
E. Detournay, et al, "A phenomenological model of the drilling action of drag bits," International Journal of Rock . Mechanics and Mining Sciences, 29(1): 13-23.
E. Detournay, et al., "Drilling response of drag bits: Theory and experiment," International Journal of Rock Mechanics and Mining Sciences, vol. 45, Issue 8, 2008, pp. 1347-1360.
A.J. White, et al, "The use of leak-off tests as means of predicting minimum in-situ stress," Petroleum Geoscience, vol. 8, 2002, pp. 189-193.
A.M. Raaen, et al, "Improved routine estimation of the minimum horizontal stress component from extended leak-off tests," International Journal of Rock Mechanics & Mining Sciences 43, 2006, pp. 37-48.
M.J. Thiercelin, et al., "A Core-Based Prediction of Lithologic Stress Contrasts in East Texas Formations," SPE Formation Evaluation vol. 9, No. 4, Society of Petroleum Engineers, 21847.
G.A. Waters, et al, "The Effect of Mechanical Properties Anisotropy in the Generation of Hydraulic Fractures in Organic Shales," SPE Annual Technical Conference and Exhibition, Oct. 30-Nov. 2, 2011, Denver, Col. USA SPE 146776.
C. Cipolla, et al, "New Algorithms and Integrated Workflow for Tight Gas and Shale Completions," SPE Annual Technical Conference and Exhibition, Oct. 30-Nov. 2, 2011, Denver, Col. USA, SPE 146872.
B.A. Schumacher, "Methods for the Determination of Total Organic Carbon (TOC) in Soils and sediments," NCEA-C-1282, EMASC-001, Apr. 2002.
Economides and Nolte, "Reservoir stimulation," 2000, Wiley, 3rd edition.
International Search Report and Written Opinion for the equivalent PCT patent application No. PCT/US2012/035869 issued on Jul. 18, 2013.

* cited by examiner

*Details of 121: Depth calibration of cuttings using GR*

*Details of 132: Analysis for mineralogy, kerogen content and maturity*

*Alternative to 132: Analysis for inorganic and organic components of cuttings*

*Details of 133:* Analysis of gas sorption for surface area and pore volume

*Details of 134:* Analysis for porosity

*Details of 135: Analysis for elastic properties*

*Details of 136: Analysis for intrinsic specific energy and rock strength*

*Details of 137: Analysis for closure stress*

RESERVOIR AND COMPLETION QUALITY ASSESSMENT IN UNCONVENTIONAL (SHALE GAS) WELLS WITHOUT LOGS OR CORE

FIELD

This application relates to methods and apparatus to provide information for the recovery of hydrocarbons. Specifically, embodiments described herein collect information and manipulate it to efficiently stage a well services operation without reliance on wireline tools or logging while drilling activities.

BACKGROUND

Often, an oil field service will be selected and tailored in response to information collected by logging while drilling and/or by exposing a region of a wellbore to a wireline tool. These methods require equipment that is delicate and expensive and methods that require human and computational resources that are burdensome, especially in remote locations or with wells that may generate smaller returns on investment. In formations that are in remote locations or that do not have recovery plans with the economic resources for these tools, low-cost, local, low technology methods are selected to roughly estimate the reservoir properties.

Some oil field services may require geomechanical properties of a formation for a variety of reasons without the use of a logging while drilling tool or wireline tool. There may be a need to complement tool failure. A wellbore may be drilled without core data or log information. A drilling regime may include multiple lateral wells from one initial wellbore and the costs for core and/or log data may be unreasonably burdensome. Some embodiments may use a drill string with no tools for logging. Some embodiments may be performed on site in near real time without time for data actualization, that is, the drill string may remain in the wellbore as people timely use the information available to them without remote mathematical analysis and without operating time lag. Some embodiments may manipulate the data in time to guide the completion time. Also, some of the techniques to address these issues, such as laboratory measurements and some logs, require post-analysis, and interpretation of the data that cannot be done within the drilling timeframe.

Further, while some vertical pilot wells are logged and evaluated in an unconventional play, stimulated horizontal wells are rarely logged or cored. The cost of acquiring the information and/or the associated rig time needed during acquisition (which means that the rig cannot be used for drilling or stimulation elsewhere) are two main reasons for this trend. On the other hand, most of the production from a horizontal well comes from a small portion of the completed section. A typical number is 70/30, implying that 70 percent of the production comes from 30 percent of the horizontal well. More efficient use of funds and resources is warranted. Change can only take place with better understanding of the reservoir and completion quality of the formations which require petrophysical and geomechanical data. The solution must be low cost and efficient in terms of delivery times (real or near real-time). It must not introduce any inefficiency into the development program (such as extended rig time for data acquisition) and must be based on a simple workflow that can be carried at the wellsite by non-experts.

Also, the hydraulic fracturing stimulation of unconventional organic shale reservoirs is performed today in mostly horizontal wells where heterogeneities of petrophysical and mechanical properties along the well are known to be very significant. Staging requires the identification of sections of the well with both good reservoir quality and good completion quality. Completion quality estimates rely on changes in elastic, rock strength, and stress properties along the well reflect variations (heterogeneity) of mechanical properties along the well.

SUMMARY

Embodiments herein relate to a method for recovering hydrocarbons from a formation including collecting and analyzing a formation sample, estimating a reservoir and completion quality, and performing an oil field service in a region of the formation comprising the quality. Embodiments herein relate to a method for recovering hydrocarbons from a formation including collecting and analyzing a formation sample and a gas record, estimating a reservoir and completion quality, and performing an oil field service in a region of the formation comprising the quality. Embodiments herein relate to a method for recovering hydrocarbons from a formation including collecting and analyzing a formation sample, drilling operation data, and wellbore pressure measurement, estimating a reservoir and completion quality, and performing an oil field service in a region of the formation comprising the quality.

Embodiments herein relate to a method for recovering hydrocarbons from a formation including collecting and analyzing drilling operation data and wellbore pressure measurement, estimating a reservoir and completion quality, and performing an oil field service in a region of the formation comprising the quality. Embodiments herein relate to a method for recovering hydrocarbons from a formation including collecting and analyzing a formation sample, drilling operation data, gas record, and wellbore pressure measurement, estimating a reservoir and completion quality, and performing an oil field service in a region of the formation comprising the quality. Embodiments herein relate to a method for recovering hydrocarbons from a formation including collecting and analyzing a gas record, estimating a reservoir and completion quality, and performing an oil field service in a region of the formation comprising the quality. Embodiments herein relate to a method for recovering hydrocarbons from a formation including collecting and analyzing drilling operation data, estimating a reservoir and completion quality, and performing an oil field service in a region of the formation comprising the quality. Embodiments herein relate to a method for recovering hydrocarbons from a formation including collecting and analyzing a formation sample, drilling operation data, and/or wellbore pressure measurement, estimating a reservoir and completion quality, and performing an oil field service in a region of the formation comprising the quality. In some embodiments, the formation sample is a solid collected from the drilling operation or includes cuttings or a core sample.

FIGURES

DESCRIPTION

Figure 1:
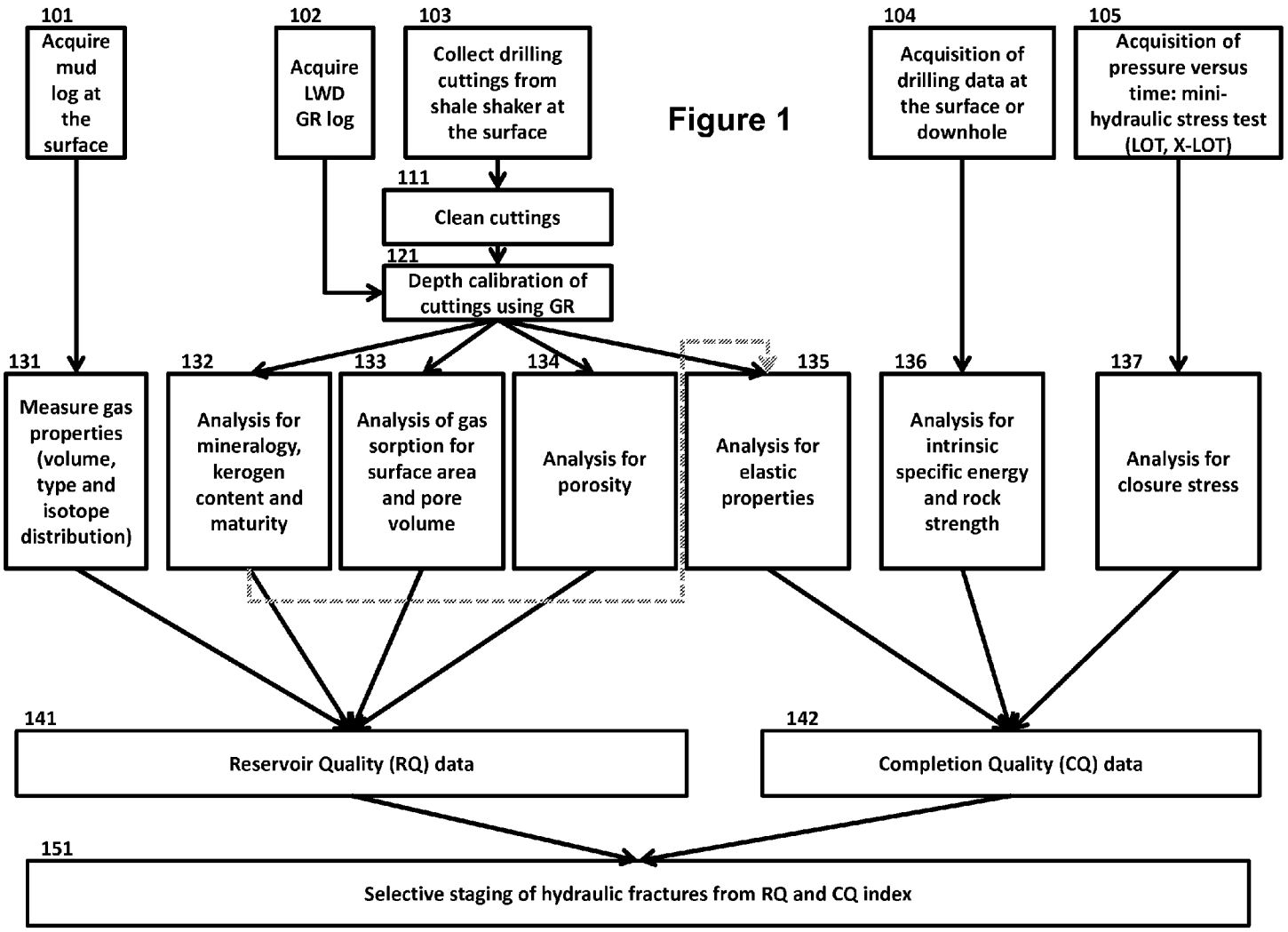
FIG. 1 is a flow chart illustrating components of an integrated process for combining information from a variety of sources.

At the outset, it should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the invention and this detailed description, each numerical value should be read once as modified by the term "about" (unless already expressly so modified), and then read again as not so modified unless otherwise indicated in context. Also, in the summary of the invention and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range.

The statements made herein merely provide information related to the present disclosure and may not constitute prior art, and may describe some embodiments illustrating the invention.

Definitions

The reservoir quality (hereafter RQ) is defined by a number of petrophysical and hydrocarbon properties (e.g., porosity, permeability, total organic content versus total inorganic content and maturation, hydrocarbon content and type, gas sorption mechanisms) defining reservoir potential.

The completion quality (CQ) depends on the poromechanical properties of the field and reservoir, which means the conditions that are favorable to the creation, propagation and containment of hydraulic fractures, as well as the placement of proppant and retention of fracture conductivity. It depends mainly on the intrinsic geomechanics properties, i.e., in situ stress field, pore pressure, material properties (elastic, yield or quasi-brittle failure, hardness, rock-fluid sensitivity), their anisotropic nature and their spatial heterogeneities, as well as the presence of discontinuities (such as natural fractures or geological layering) and the orientation of the well. SPE 144326 provides more information for the definitions of RQ and CQ and is incorporated by reference herein.

Elastic properties include the properties of in situ rocks under either isotropic or anisotropic conditions including Young's moduli, Poisson ratios and shear moduli in classical solid mechanics (E and v for isotropic rocks; $E_h$, $E_v$, $v_h$, $v_v$, and $G_v$ for transversely anisotropic rocks also referred as TI rocks).

Rock strength of in situ rocks under either isotropic or anisotropic conditions is known as compressive strength UCS, tensile strength TS and fracture toughness KIC.

In situ stress field and pore pressure and its spatial variations within the reservoir include the orientation and magnitude of the minimum stress (often the minimum horizontal stress) and are critical to design hydraulic fracturing (this stress is also referred as the closure stress in hydraulic fracturing stimulation literature). The other two stress magnitudes (often the vertical and maximum horizontal stress, if vertical stress is maximum), as well as the pore pressure are also important.

Further, as a well is being drilled, the rock that is undergoing the drilling is cut or otherwise fragmented into small pieces, called "cuttings," that are removed from the bulk of the formation via drilling fluid. The process is similar to drilling a hole in a piece of wood which results in the wood being cut into shavings and/or sawdust. Cuttings are representative of the reservoir rock—although they have been altered by the drilling process, they still may provide an understanding of the reservoir rock properties. This is often referred to as "mud logging" or "cuttings evaluation." For effective logging or evaluation as described below, the cuttings are prepared by removing residual drilling fluids.

Staging is the design of the locations of the multiple hydraulic fracturing stages and/or perforation clusters, an interval for which services will be performed on a well. A single stage, which is individually designed, planned and executed, comprises one part in a series of work to be done on the well. Stages are usually defined by a sequential list of numbers and may include a description of the well depth interval(s) and or services to be performed. Stages can also relate to the people, equipment, technical designs or time periods for each interval (typically related to pressure pumping).

The term "unconventional" is used refer to a formation where the source and reservoir are the same, and stimulation is required to create production.

The "source" aspect implies that the formation contains appreciable amounts of organic matter, which through maturation has generated hydrocarbons (gas or oil, as in Barnett and Eagle Ford, respectively).

The "reservoir" aspect signifies that the hydrocarbons have not been able to escape and are trapped in the same space where they were generated. Such formations have extremely low permeabilities, in the order of nanodarcies, which explains why stimulation in the form of hydraulic fracturing is needed.

Bitumen and kerogen are the non-mobile, organic parts of shales. Bitumen is defined as the fraction that is soluble in a solvent (typically a polar solvent such as chloroform or a polarizable solvent such as benzene). Kerogen is defined as the fraction that is insoluble.

Rock cores are reservoir rocks collected with a special tool that produces large samples with little exposure to drilling fluids.

Wireline (WL) is related to any aspect of logging that employs an electrical cable to lower tools into the borehole and to transmit data. Wireline logging is distinct from measurements-while-drilling (MWD) and mud logging.

Measurements-while-drilling includes evaluation of physical properties, usually including pressure, temperature and wellbore trajectory in three-dimensional space, while extending a wellbore. MWD is now standard practice in offshore directional wells, where the tool cost is offset by rig time and wellbore stability considerations if other tools are used. The measurements are made downhole, stored in solid-state memory for some time and later transmitted to the surface. Data transmission methods vary from company to company, but usually involve digitally encoding data and transmitting to the surface as pressure pulses in the mud system. These pressures may be positive, negative or continuous sine waves. Some MWD tools have the ability to store the measurements for later retrieval with wireline or when the tool is tripped out of the hole if the data transmission link fails.

MWD tools that measure formation parameters (resistivity, porosity, sonic velocity, gamma ray) are referred to as logging-while-drilling (LWD) tools. LWD tools use similar data storage and transmission systems, with some having more solid-state memory to provide higher resolution logs after the tool is tripped out than is possible with the relatively low bandwidth, mud-pulse data transmission system. Embodiments described herein relate to the field of geomechanics and its application to the oil and gas industry. Geomechanics is an integrated domain linking in situ physical measurements of rock mechanical properties via wellbore logging or wellbore drilling, in situ hydraulic measurements of in situ pore pressure and stress field, surface laboratory measurements on cores to engineering practices for drilling, fracturing and reservoir purposes via the construction of integrated earth models, and modeling tools and workflows.

Reservoir Quality and Completion Quality

Formation evaluation in gas shale and oil-bearing shale reservoirs involves estimation of quantities such as mineralogy, kerogen content and thermal maturity (reflecting the extent of alteration of the kerogen due to thermal processes). These quantities are important for estimating the reservoir quality and completion quality of the formation, and measurement of these quantities as a function of depth is desirable in nearly every well in shale plays. Embodiments herein provide a procedure for estimating all three of these quantities. This could be performed simultaneously using Fourier Transform Infrared Spectroscopy (FTIR) as described below. We could also do it not simultaneously using a combination of X-Ray Fluorescence (XRF) X-Ray Diffraction (XRD) and Diffuse Reflectance Infrared Fourier Transform Spectroscopy (DRIFTS) or other methods described below. The procedure involves the use of infrared spectroscopy, for example infrared spectroscopy recorded using a Fourier transform technique (FTIR) as is commonly used for estimating mineralogy in conventional rocks that have been cleaned of hydrocarbons. These measurements can be performed using FTIR spectra recorded in diffuse reflection mode, transmission mode, photoacoustic mode, with a diamond-window compression cell. Some embodiments may also use XRD, XRF, and/or DRIFTS.

Embodiments described herein fully exploit the data that may be collected using cuttings and/or core samples, drilling operation data, pressure tests, gamma ray feedback, and/or other methods to estimate reservoir quality and completion quality. The overall goal is to provide timely, lower cost formation property estimates to facilitate more efficient drilling, staging for hydraulic fracturing, perforation cluster position, completions, and/or general reservoir planning and management. The different methods employed by embodiments of the invention to estimate elastic properties, rock strength, and minimum horizontal stress may vary from wellbore to wellbore and wellbore region to wellbore region. The overall goal of the process is selective staging. An intermediate goal is characterization of three geomechanical properties: elastic properties, rock strength and minimum stress magnitude to facilitate efficient recovery of hydrocarbons. Characterization of the mineral (inorganic) and nonmineral (organic) content of formation samples is the objective including weight fractions of inorganic and organic content, total organic content (TOC), and/or mineralogy.

Generally, embodiments described herein relate to collecting and analyzing a formation sample, data from a drilling operation, and data from a wellbore pressure measurement; estimating a reservoir and completion quality; and performing an oil field service in a region of the formation comprising the quality. The reservoir qualities may include a mud gas log, DRIFTS, Gas Sorption, XRD, XRF, Natural Spectral Gamma Ray (GR) Nuclear Magnetic Resonance (NMR), drilling data, calcimetry or a combination thereof. One embodiment offers a reservoir and/or production engineering solution based on concepts developed from reservoir geoscience subspecialties of petrophysics, geochemistry and geomechanics; by providing data on reservoir and completion quality, which can be used to optimize a stimulation program (hydraulic fracturing) in the planning stage, or assess the source of discrepancies among different wells in the post-mortem phase.

The integration of several measurements in a seamless and meaningful way to provide an answer to guide a completion (stimulation) program, at the well site at or near real-time conditions, in an efficient way (no additional rig time) and at low cost is desirable. The sample cleaning and preparation methodologies developed herein, as well as the extraction of rock strength properties from drilling data are also described herein.

In particular, some embodiments characterize the geomechanical properties of a formation along a borehole while it is being drilled. Embodiments may be targeted to lateral wells in unconventional shale reservoirs where hydraulic fracturing is performed. The characterization relates to up to three key properties: (1) elastic properties, (2) rock strength and (3) minimum stress magnitude. Generally, (1) the characterization is done without the need for WL or LWD logs, although if present, they are used as redundant and complementary information (2) the acquisition and analysis of the data is done as we drill the well (often not real time but within the timeframe of the drilling time), and (3) relies on a combination of techniques bundled together. These techniques rely upon combined information and combined analysis techniques and material recovery methods. Combining the information provides more definitive knowledge of a formation by combining this information to characterize reservoir quality and completion quality to craft a staging routine with efficiency and greater volume of hydrocarbon recovery.

Flow Charts

FIG. 1 is a flow chart illustrating one embodiment of the methods described herein, components of an integrated process for combining information from a variety of sources. Additional embodiments may include additional steps or delete some steps. An exact order of data collection and manipulation is not implied by FIG. 1. Some embodiments may benefit from repeating steps and some embodiments may omit some steps.

Initial Data Collection

Box 101: Acquire Mud Log at Surface

In this step 101, hydrocarbon gases entrained in the drilling fluid are extracted and analyzed. The process is repeated while the well is drilled, producing a log of the gas analysis. Hydrocarbon gases enter the drilling fluid primarily when the rock containing them is crushed by the drill bit and possibly also by flow from the formation to the borehole (depending on the difference between the formation pore pressure and the wellbore pressure). Thus, this procedure produces a log of hydrocarbon gas content and composition over the course of the well.

The measurement occurs by extracting hydrocarbon gases from the drilling fluid and then analyzing those gases. Extraction is performed using an extractor or a degasser such as the FLEX™ fluid extractor commercially available from Schlumberger Technology Corporation of Sugar Land, Tex. that heats the drilling mud to a constant temperature and maintains a stable air-to-mud ratio inside the extraction chamber. Analysis occurs with a gas chromatograph or a gas chromatograph/mass spectrometer such as the FLAIR™ system which is commercially available from Sugar Land, Tex. Analysis can also involve isotope measurements which are commercially available from Schlumberger Technology Corporation of Sugar Land, Tex. Analysis can also use tandem mass spectrometry as described in U.S. patent application Ser. No. 13/267,576, entitled, "Fast Mud Gas Logging using Tandem Mass Spectroscopy," filed Oct. 6, 2011, and incorporated by reference herein in its entirety.

Preferably the concentration of gases entering the well is subtracted from the concentration of gases exiting the well to correct for gas recycling.

Box 102: Acquire LWD GR Log

This step 102 involves measuring the amount of naturally-occurring gamma radiation. The measurement provides information about the chemical composition of the formation, in particular the uranium, thorium and potassium concentrations. In LWD, the measurement is commonly run in one of four modes: total gamma ray (providing a weighted average of the uranium, thorium, and potassium concentrations), spectral gamma ray (estimating the individual concentrations of uranium, thorium, and potassium), azimuthal gamma ray (provides a borehole image of the gamma ray response), and gamma ray close to the drill bit (places the sensor relatively close to the drill bit). Each of those modes delivers a total gamma ray value; some also deliver additional information.

This measurement is performed using a scintillation detector. It can be performed with common MWD tools such as PATHFINDER™, which is commercially available from Schlumberger Technology Corporation of Sugar Land, Tex.

Box 103: Collect Drilling Cuttings From the Shaker at the Surface

This step 103 involves removing the cuttings from the mud, as is necessary for subsequent analysis of the cuttings. Cuttings can be removed from the mud using a shale shaker, which is a vibrating mesh with an opening around 150 microns. Cuttings are collected from the top of the shaker while mud falls through the shaker. Additional process steps 103 and 111 are more fully described in U.S. patent application Ser. No. 13/446,985, Method and Apparatus to Prepare Drill Cuttings for Petrophysical Analysis by Infrared Spectroscopy and Gas Sorption, filed Apr. 13, 2012, which is incorporated by reference herein.

Box 111: Clean Cuttings

Cuttings collected in step 103 are coated with mud, including a base fluid (typically either oil or water) and numerous liquid and solid additives. The mud must be substantially removed from the cuttings or it will impact the subsequent analyses (steps 132-135). In particular, oil base fluids and organic mud additives contain organic carbon, which if left on the cuttings will artificially elevate the kerogen (organic carbon) measurement in step 132.

Cuttings from wells drilled with oil based mud can be cleaned by washing them with a solvent such as the base oil over a sieve with opening size similar to the shale shaker's. The washing step can include agitation of the cuttings in solvent, for example using a rock tumbler. The solvent can be supplemented with a surfactant such as ethylene glycol monobutyl ether. Subsequent washing with a volatile solvent such a pentane can be used to remove residual base oil. Ideally, another washing will be performed at elevated temperature, elevated pressure and/or reduced particle size to remove mud more effectively.

Box 121: Depth Calibration of Cuttings Using GR

In order to interpret cuttings data, the depth interval represented by cuttings samples must be well known. An initial estimate of the depth interval is typically obtained from the known depth of the bit, borehole size and mud circulation rate. However, this estimate is often insufficient. Additionally, this estimate does not account for the possibility of cuttings being trapped in highly deviated sections of the well, contamination from formation material at other depths caving into the well, etc.

A more accurate estimate of the cuttings depth can be obtained by comparing the gamma ray value of cuttings with the gamma ray value measured in 102. If the two gamma ray values match, the cuttings are considered representative of the formation at that depth. The match can occur using the initially estimated cuttings depth or after applying a small shift to the depth. If no agreement is found, the cuttings are flagged as not being representative of the formation.

The gamma ray value of cuttings can be measured in multiple ways. As an example, direct gamma ray measurement is described in Ton Loermans, Farouk Kimour, Charles Bradford, Yacine Meridji, Karim Bondabou, Pawel Kasprzykowski, Reda Karoum, Mathieu Naigeon, Alberto Marsala, 2011, Results From Pilot Tests Prove the Potential of Advanced Mud Logging. SPE/DGS Saudi Arabia Section Technical Symposium and Exhibition, 15-18 May 2011, Al-Khobar, Saudi Arabia; Society of Petroleum Engineers 149134, which is incorporated by reference herein. As another example, the gamma ray value can be computed from the concentrations of Thorium, Uranium, and Potassium, using the known equation:

$$\text{Gamma ray } (API) = 4*\text{Th } (ppm) + 8*U(ppm) + 16*K(\%).$$

The Concentrations of Th, U and K can be measured using x-ray fluorescence.

Figure 2:
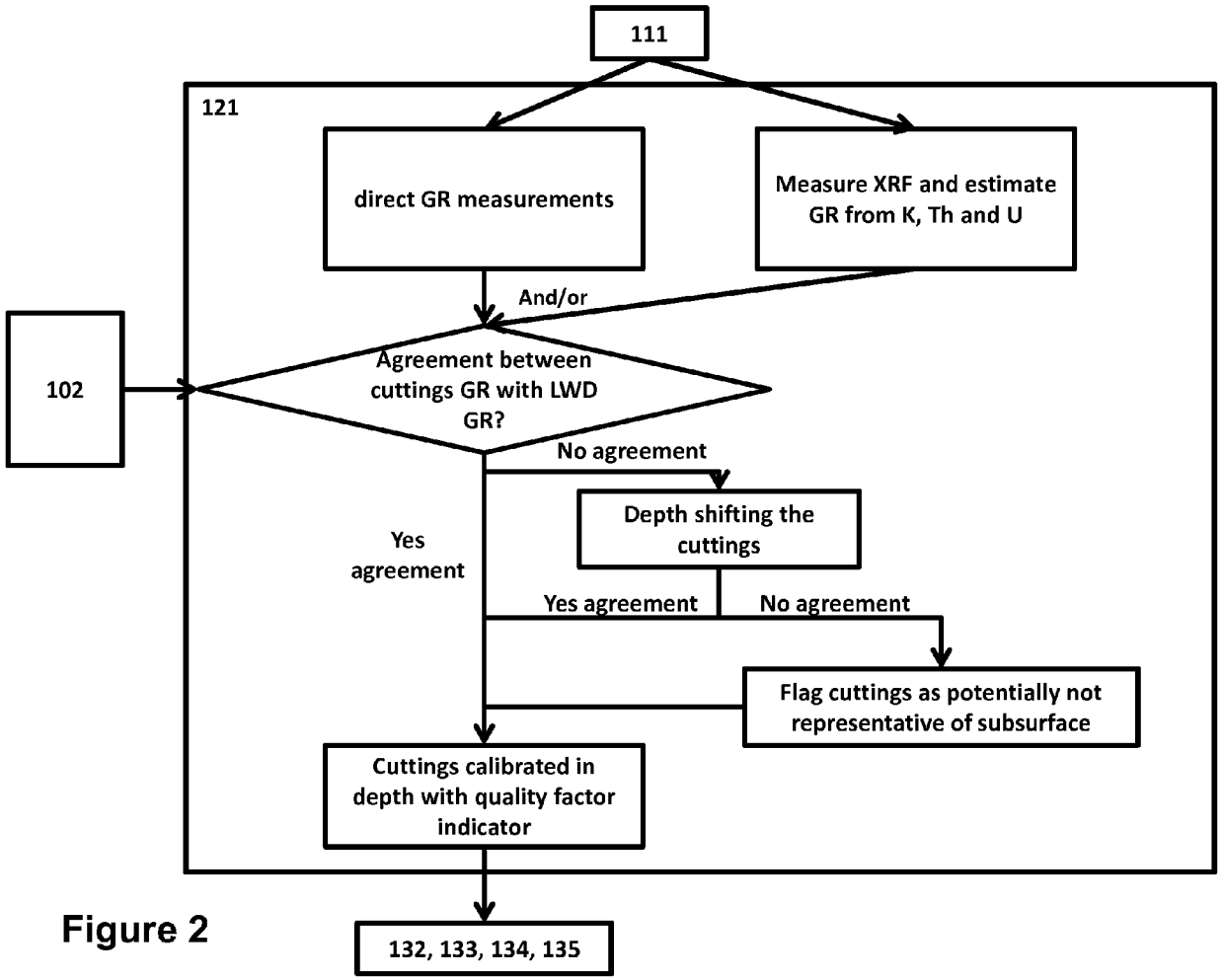
FIG. 2 is a flow chart illustrating components of depth calibration of cuttings using gamma ray information.

FIG. 2 provides a flow chart of step 121. Specifically, the direct gamma ray and/or XRF and estimated GR from K, Th, and U measurements are used to determine agreement between the direct and LWD gamma rays. When there is good alignment, the cuttings are calibrated in depth with a quality factor indicator. If there is poor agreement, depth shift may be used until there is good agreement at which time the cutting are considered calibrated in depth with a quality factor indicator. If no form of depth shifting results in good agreement, the cuttings may be flagged as not representative of the formation subsurface. Some embodiments may benefit from comparing the gamma ray data and formation sample for depth matching. Some embodiments may benefit from identifying samples that are not representative of the subsurface. In some embodiments, the not representative sample identification is used to assess the quantitative uncertainty in the quality.

Box 104: Acquisition of Drilling Data at the Surface or Downhole

This step 104 involves the acquisition of accurate drilling data using either measurements at the surface on the rig or downhole in situ measurements. Typically, surface drilling measurements at the surface on the rig include: (1) top drive or rotary table angular rotational speed (SRPM), (2) top drive or rotary table torque to estimate "surface" torque-on-bit (STOB), (3) Hook load pressure (consisting of string weight minus weight of displaced mud; the string weight being the kelly assembly or top drive, drill string, bottom hole assembly and drill bit) to estimate "surface" weight-on-bit (SWOB), (4) Block position to estimate "surface" rate-of-penetration (SROP) and depth (hole and bit).

Typically, downhole drilling measurements include direct measurements of at- or near-bit weight-on-bit (WOB), torque-on-bit (TOB), rate-of-penetration (ROP) and angle rotational speed of the bit (RPM), for example using Schlumberger's Integrated weight on bit sub which is commercially available from Schlumberger Technology Corporation of Sugar Land, Tex.

Box 105: Acquisition of Pressure Versus Time: Mini-Hydraulic Stress Test (LOT, X-LOT)

This step 105 involves the acquisition of data to measure in situ closure stress from mini-hydraulic fracture test. During drilling, this type of test can be performed either after the casing and cement is set as a formation integrity test at the bottom of casings or using an inflatable packer to isolate the bottom of the wellbore. The formation integrity test requires to drill out cement and around 10 feet of new formation, whereas the openhole packer test requires to install a open packer assembly on a bottom hole assembly. Both require installing measurements devices downhole and at the surface to record tubing pressure, annulus pressure and flow rate during pumping. Then, microfracturing is done by pumping of drilling mud as fracturing fluid. Details description of the sequence of events to perform such tests is provided via several references including two SPE papers A. A. Daneshy, G. L. Slusher, P. T. Chisholm, D. A. Magee "In Situ Stress Measurements During Drilling" Journal of Petroleum technology, August 1986, SPE 1322 and K. R. Kunze and R. P. Steiger, Exxon Production Research Co. 1992 "Accurate In situ Stress Measurements During Drilling Operations" SPE 24593, both of these papers are incorporated by reference herein. One adequate field test procedure is known as extended leakoff test (XLOT). In order to estimate a closure representative of the formation, multiple leakoff cycles are conducted, accurate surface and downhole pressure is measured, after shut-in, pressure decrease is monitored for a sufficient time (~30 minutes), fluid densities are measured accurately.

Analysis Steps 131-137

Box 131: Measure Gas Properties Including Volume, Type, and Isotope Distribution For the performance of step 131, measuring the gas properties including volume, type, and isotope distribution, the analysis of box 101 returns three sets of values. First, the concentration of gases is measured. The concentration is measured of each gas in air, but using the flow rates that can be converted to the concentration of gas in the mud. Second, the composition of the gas is measured. Gases in the range C1-C5 or C1-C8 are commonly determined, for example, as in Daniel McKinney, Matthew Flannery, Hani Elshahawi, Artur Stankiewicz, Ed Clarke, Jerome Breviere and Sachin Sharma, 2007, Advanced Mud Gas Logging in Combination with Wireline Formation Testing and Geochemical Fingerprinting for an Improved Understanding of Reservoir Architecture, SPE Annual Technical Conference and Exhibition, 11-14 Nov. 2007, Anaheim, Calif., U.S.A, Society of Petroleum Engineers 109861, which is incorporated by reference herein. Third, the isotopic composition of the gases is measured. Commonly the $\delta^{13}C$ value of $CH_4$ is determined. Other measurements such as the $\delta^{13}C$ value of all of the gases, the $\delta^{2}H$ values or clumped isotopes can be determined. These measurements are repeated while the well is drilled to form a log.

Box 132: Analysis For Mineralogy, Kerogen Content and Maturity

This step 132 involves measuring the chemical composition of the cuttings. First, the mineralogy is measured using techniques such as vibrational spectroscopy (including infrared spectroscopy in transmission, diffuse reflection or photoacoustic mode as well as Raman spectroscopy in transmission or reflection mode), x-ray fluorescence, x-ray diffraction, scanning electron microscopy, energy dispersive spectroscopy, and wavelength dispersive spectroscopy. Second, the kerogen content (or total organic content) is measured using techniques such as vibrational spectroscopy, acidization followed by combustion, the indirect method or Rock Eval such as the output from a Rock Eval 6 analyzer which is commercially available from Vinci Technologies of Nanterre, France. Third, the maturity is measured using techniques such as vibrational spectroscopy, Rock Eval, petrography including vitrinite reflectance such as the service provided by Pearson Coal Petrography of South Holland, Ill., thermal alteration index, or elemental analysis. Preferably these quantities are measured simultaneously. For example, U.S. Provisional Patent Application Ser. No. 61/523,650, incorporated by reference herein, describes a method to measure mineralogy and kerogen content simultaneously using infrared spectroscopy in diffuse reflection mode. As another example, describes a method to measure mineralogy, kerogen content and maturity simultaneously using infrared spectroscopy. U.S. patent application Ser. No. 13/446,975, filed Apr. 13, 2012 entitled METHODS AND APPARATUS FOR SIMULTANEOUS ESTIMATION OF QUANTITATIVE MINEROLOGY, KEROGEN CONTENT AND MATURITY IN GAS SHALE AND OIL-BEARING SHALE provides more details and is incorporated by reference herein. These measurements are repeated while the well is drilled to form a log.

Figure 3:
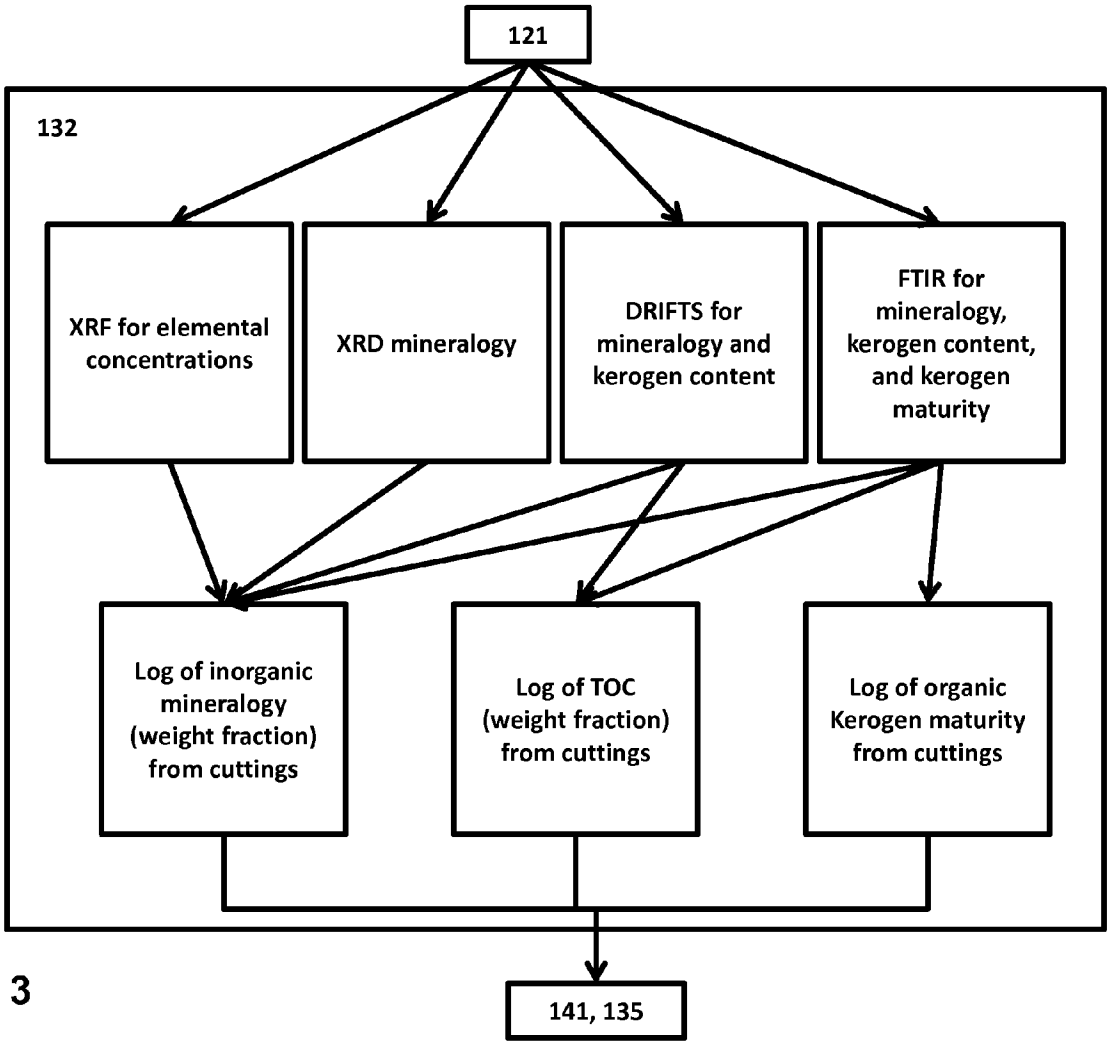
FIG. 3 is a flow chart illustrating components of mineralogy, kerogen content, and maturity analysis.
Figure 4:
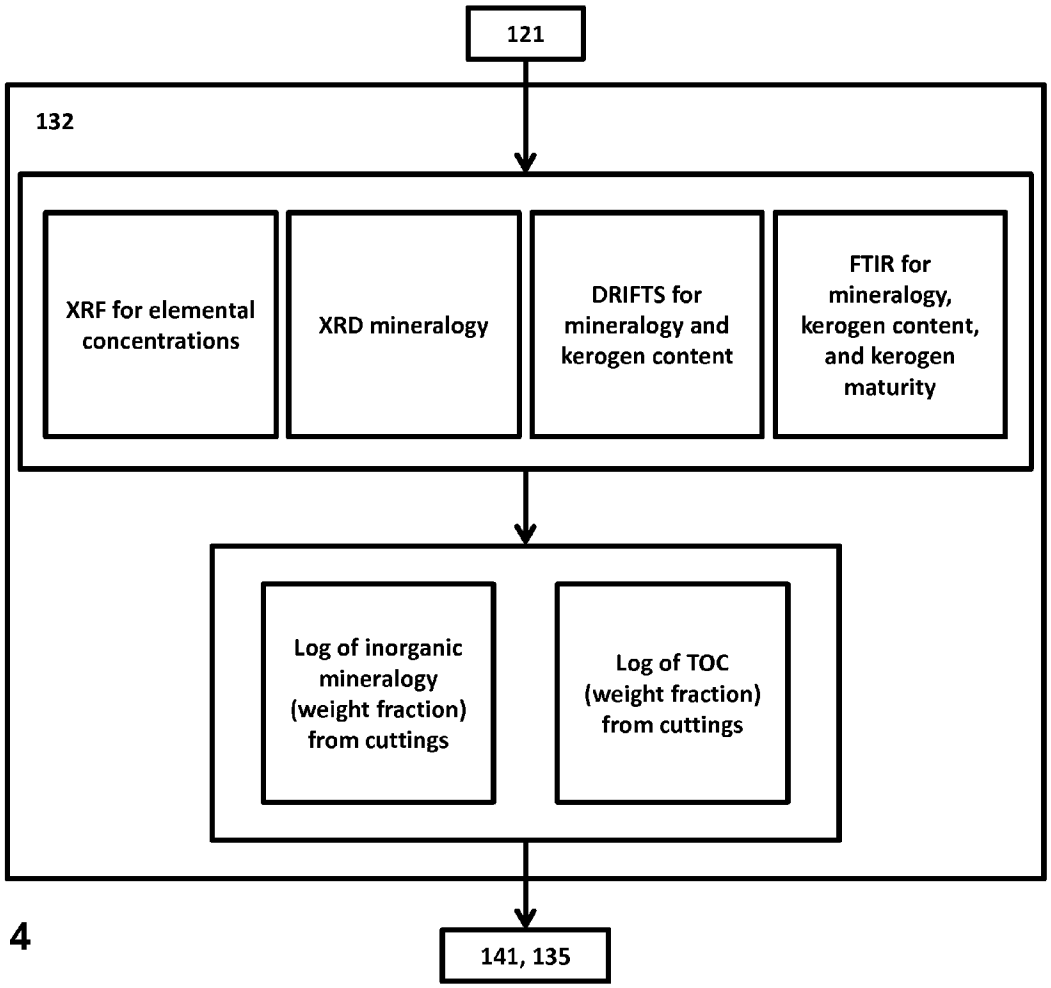
FIG. 4 is a flow chart illustrating components of mineralogy, kerogen content, and maturity analysis.

FIG. 3 is a flow chart of one embodiment of analysis for mineralogy, kerogen content, and maturity with details for one embodiment of step 132. XRF for elemental concentrations, XRD mineralogy, DRIFTS for mineralogy and kerogen content, and FTIR for mineralogy kerogen content, and kerogen maturity may be performed and combined to provide a log of inorganic mineralogy (weight fraction) from cuttings. The DRIFTS and FTIR results may be used to form a log of total organic content (weight fraction) from cuttings. The FTIR results may be used to form a log of organic kerogen maturity from cuttings. As the arrows indicate, the constituent steps may be combined. In some embodiments, the XRF and XRD data may form one log. These logs may be combined for an analysis of elastic properties and for reservoir quality characterization. FIG. 4 provides additional details of how the processes may work together. In some embodiments, XRF, XRD, DRIFTS and FTIR may all be performed. In some embodiments only three of the four may be performed. In some embodiments, only one or two may be performed. The results of the processes may be performed to form a log of inorganic mineralogy and/or of TOC.

Box 133: Analysis of Gas Sorption For Surface Area and Pore Volume

This step 133 involves measuring the physical structure of the cuttings. The gas sorption of shale is measured and interpreted following the method of U.S. patent application Ser. No. 13/359,121, entitled, "Gas Sorption Analysis of Unconventional Rock Samples," filed Jan. 26, 2012, and incorporated by reference herein. The procedure involves an instrument such as Micromeritics ASAP 2420 commercially available Micromeritics of Norcross, Ga. and interpretation of the data following the procedure of Brunauer, S.; Emmett, P. H. & Teller, E., Adsorption of Gases in Multimolecular Layers, Journal of the American Chemical Society, 1938, 60, 309-319. The measurement produces an estimate of surface area and pore volume. Both quantities generally increase with increasing kerogen content and maturity, although for highly mature samples the surface area will begin to decrease with increasing maturity as pores coalesce. These measurements are repeated while the well is drilled to form a log.

Figure 5:
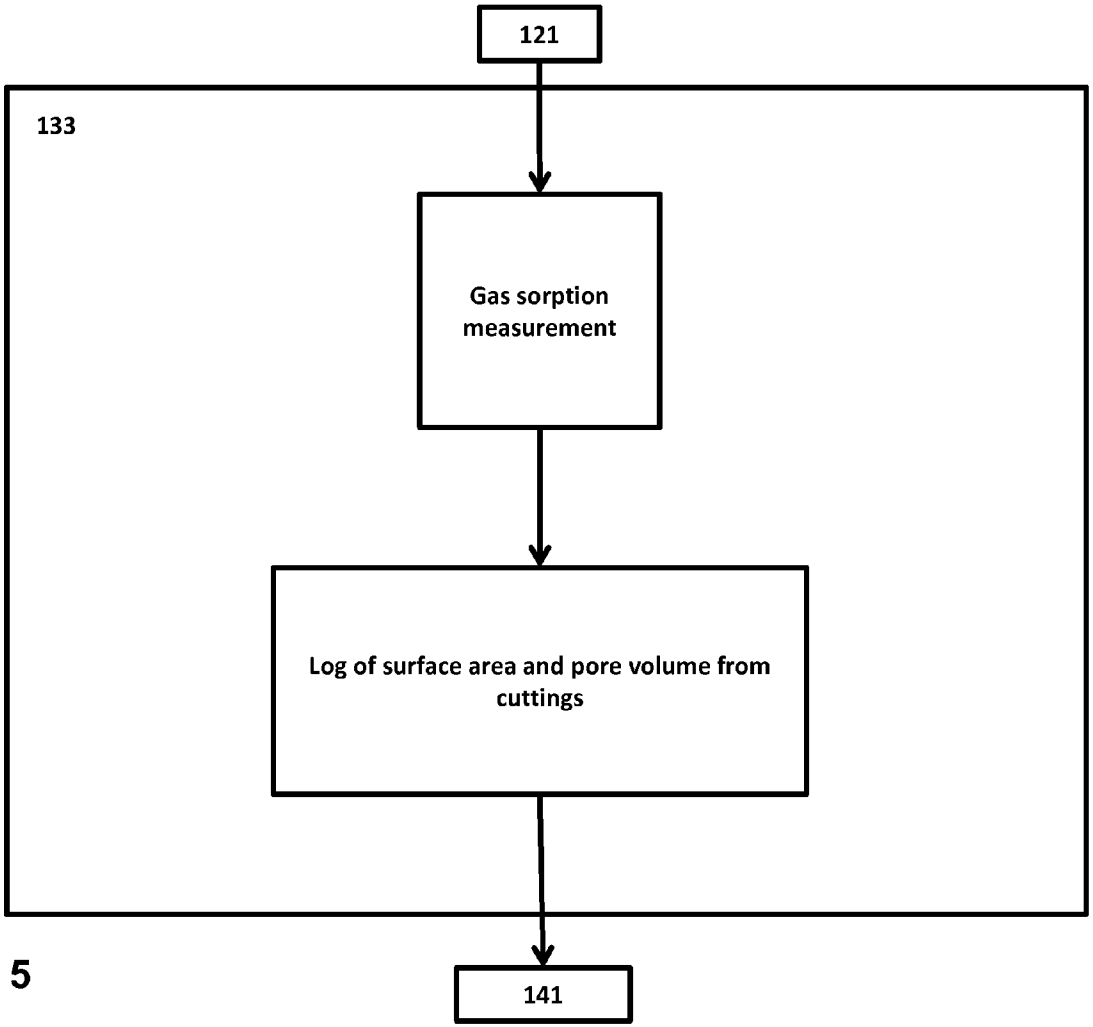
FIG. 5 is a flow chart illustrating components of gas sorption analysis for surface area and pore volume.

FIG. 5 is a flow chart of for an analysis of gas sorption for surface area and pore volume. The gas sorption measurement may be used to form a log of surface area and pore volume from cuttings and then used as a component for reservoir quality characterization.

Box 134: Analysis for Porosity

This step 134 involves measuring the porosity of the cuttings. Porosity can be measured by nuclear magnetic resonance, as described in SPE 149134. Preferably porosity is measured by combination of gas sorption and bulk density, where gas sorption is described in 133 and bulk density is measured using an instrument such as GeoPyc 1360 from Micromeritics company. These measurements are repeated while the well is drilled to form a log.

Figure 6:
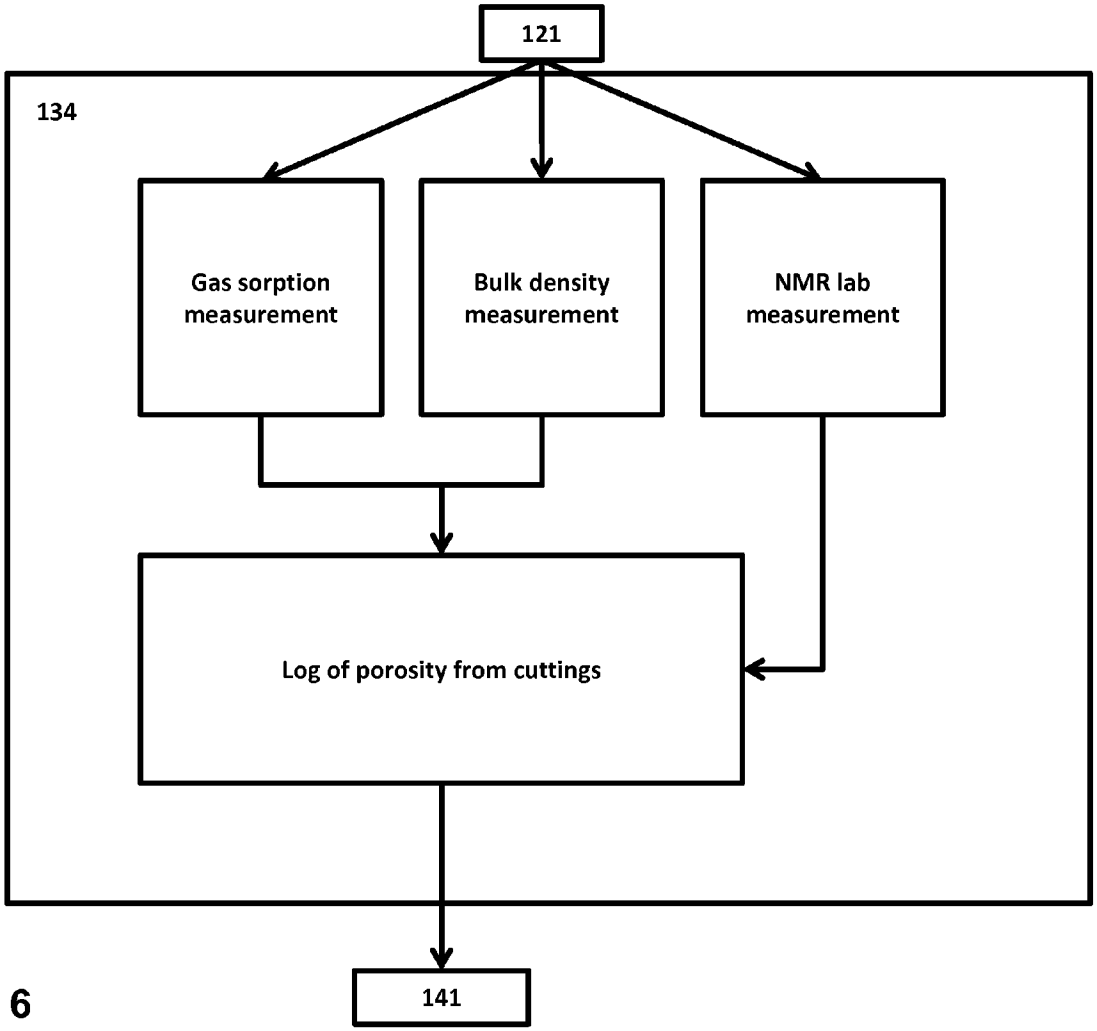
FIG. 6 is a flow chart illustrating components of porosity analysis.

FIG. 6 is a flow chart of one embodiment of this step 134. Gas sorption and bulk density measurements may be combined with NMR lab measurements to form a porosity log for reservoir quality characterization.

Box 135: Analysis for Elastic Properties

This step 135 includes the determination of the elastic properties of the drilling cuttings collected and prepared in step 103-111-121. The elastic properties are determined in two independent ways: first directly by measuring the ultrasonic velocities and second indirectly by combining a rock physics model with the knowledge of the fraction of the different mineralogical phases and porosity from previous steps.

Sub-step 1: The elastic properties of the drilling cuttings can be estimated by directly doing ultrasonic measurements of the P- and S-wave velocities using two known techniques such as the pulse transmission technique [Santarelli, F. J. et al.: Formation Evaluation From Logging on Cuttings, SPE Reservoir Evaluation & Engineering, June 1998, SPE 36851, 238-244] and continuous wave technique called CWT [Nes, O. M. et al.: Rig-Site and Laboratory Use of CWT Acoustic Velocity Measurements on Cuttings, SPE Reservoir Evaluation & Engineering, June 1998, SPE 50982]. Both of these references are incorporated by reference herein. Systems, such as CWT, are portable, fast and easy to use, and relatively inexpensive, and are capable of measuring velocities also on sub-mm-thick, finely grained samples like shale. This step can provide two velocities measurements that can be translated into two elastic moduli (Young modulus and poisson's ratio) but is unlikely to provide any information on elastic anisotropy because the mixing and rotation of the cutting samples means the original orientation of the cuttings with respect to the formation is lost.

Sub-set 2: Another ways to estimate the elastic properties, but including the anisotropy, is as follows: using the knowledge of the fraction of the different mineralogical phases (organic and inorganic) from steps 111-121-132 as well as the porosity and bulk density from steps 111-121-134, using known elastic properties of basic minerals and a rock physics model for shales taking into account the different scale involved in shales, one can compute the elastic moduli, E and, of effective elastic or poroelastic rocks. Examples of such models are shown for example by Colin M. Sayers, The effect of low aspect ratio pores on the seismic anisotropy of shales, SEG, Expanded Abstracts, 27, 2750, (2008), Joël Sarout and Yves Guéguen, Anisotropy of elastic wave velocities in deformed shales: Part 1—Experimental results, Geophysics, 73, D75, (2008), Joël Sarout and Yves Guéguen, Anisotropy of elastic wave velocities in deformed shales: Part 2—Modeling results, Geophysics, 73, D91, (2008), and J. Alberto Ortega, Microporomechanical modeling of shale, PhD, MIT, 2010, and J. Alberto Ortega, Franz-Josef Ulm, and Younane Abousleiman, The nanogranular acoustic signature of shale, Geophysics, 74, D65, (2009). These four references are incorporated by reference herein. This technique provides an estimation of anisotropic elastic properties, $E_h$, $E_v$, $v_h$, $v_v$, and $G_v$, along the well.

Figure 7:
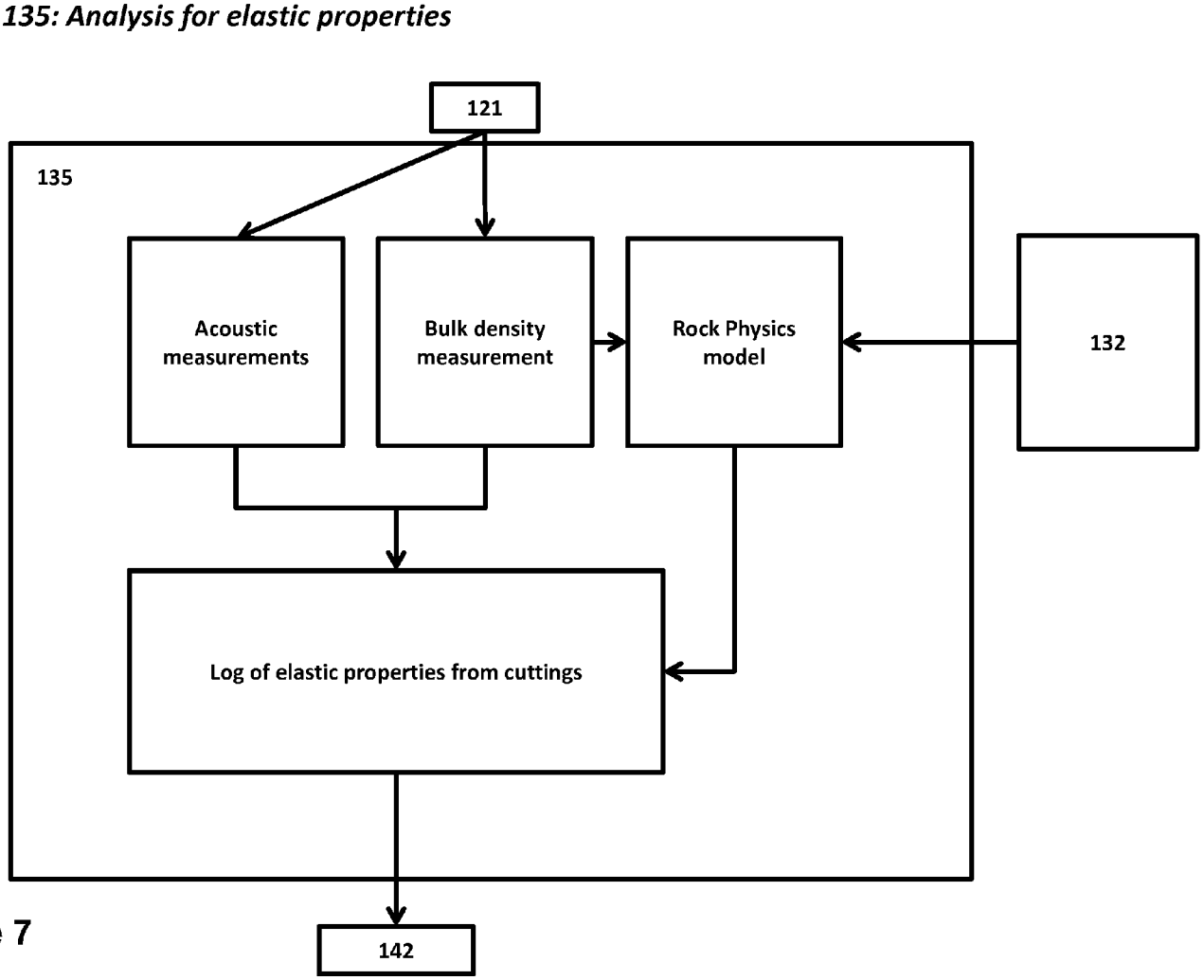
FIG. 7 is a flow chart illustrating components of elastic property analysis.

FIG. 7 is a flow chart to illustrate one embodiment of step 135. Acoustic and bulk density measurements may be combined with a rock physics model (which may also encompass results from step 132) to form an elastic property log.

Box 136: Analysis for Intrinsic Specific Energy and Rock Strength

This step combines two sub-steps: (1) one being the signal processing of the previously acquired data to isolate depth intervals where the drilling mechanics response is homogeneous for example using a Bayesian change-point methodology described by patent application WO 2010/043851 A2 which is incorporated by reference herein, and (2) another one using a mechanical model relating weight-on-bit, torque-on-bit depth of cut per revolution to intrinsic specific energy via a relationship between specific energy and drilling strength, then relating the intrinsic specific energy to compressive rock strength UCS as described by U.S. Pat. No. 5,216,917 A and PCT Patent Number WO 2010/043851 A2 which is incorporated by reference herein.

One can, for example, use the mechanical model described by Detournay, E. and P. Defourny (1992), A phenomenological model of the drilling action of drag bits, Int. J. Rock Mech. Min. Sci., 29(1):13-23 and Emmanuel Detournay, Thomas Richard, Mike Shepherd, Drilling response of drag bits: Theory and experiment, International Journal of Rock Mechanics and Mining Sciences, Volume 45, Issue 8, 2008, 1347-1360 to describe the relationship between drilling data and rock strength using a rate-independent interface law, as follows. These two references are incorporated by reference herein.

- Three basic state variables are defined as a scaled weight-on-bit $w=W/a$, scaled torque-on-bit $t=2T/(a*a)$ and the depth of cut per revolution $d=2\pi*V/\Omega$ where W(=WOB) is the weight-on-bit, T(=TOB) the torque-on-bit, V(=ROP) the rate of penetration, Ω(=RPM) the angular velocity and a is the bit radius.
- The specific energy E is defined as $E=t/d$, and the drilling strength S as $S=w/d$.
- The linear relationship between E and S that is $E=(1-\beta)\epsilon+\mu\gamma S$ (where $\epsilon$ is the intrinsic specific energy, $\mu$ is the coefficient of friction at the wear flat-rock interface and $\gamma$ a bit constant) can be used to estimate the intrinsic specific energy $\epsilon$.
- Empirical linear relationship between intrinsic specific energy $\epsilon$ and the compressive rock strength UCS can then be used.

Figure 8:
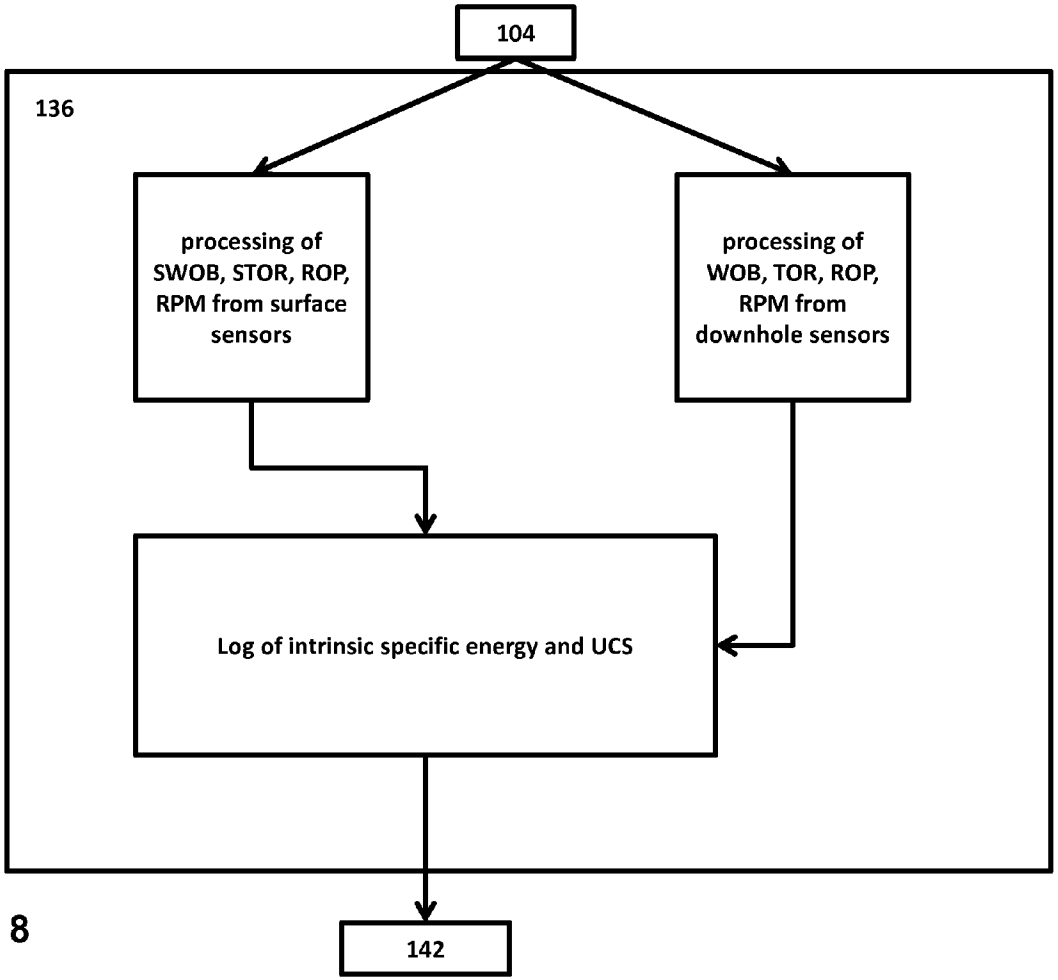
FIG. 8 is a flow chart illustrating components for intrinsic specific energy and rock strength analysis.

Using the previous model for each depth interval where the drilling mechanics response is homogeneous, one can obtain a log of intrinsic specific energy and UCS. For example, FIG. 8 is a flow chart of one embodiment of step 136. Processing the SWOD, STOR, ROP, and RPM from surface and downhole sensors can be used to form a log of intrinsic specific energy and UCS.

Box 137: Analysis for Closure Stress

The analysis of the pressure and volume as a function of time for closure is done classically on microfracturing data where the formation breakdown pressure can identified and where the pressure decline after the injection as stopped leads to the identification of the ISIP (Instantaneous shut-in pressure) pressure and the closure stress pressure. Several graphical representation of the data are possible for the analysis (known as Horner plot, G-function, etc, See book from Economides and Nolte, Reservoir stimulation, 2000, Wiley, 3rd edition). When multiple cycle are conducted and the pressure decrease is recorded for a sufficiently long time, it has been shown that accurate can be obtained. We refer to following papers for the interpretation: Adrian J. White, Martin O. Traugott, and Richard E. Swarbrick "The use of leak-off tests as means of predicting minimum in-situ stress" Petroleum Geoscience, Vol. 8 2002, pp. 189-193; A. M. Raaen, P. Horsrud, H. Kjorholt, D. Okland 2003 "Improved routine estimation of the minimum horizontal stress component from extended leak-off tests." International Journal of Rock Mechanics & Mining Sciences 43 (2006), pp. 37-48. These three papers are incorporated by reference herein.

Figure 9:
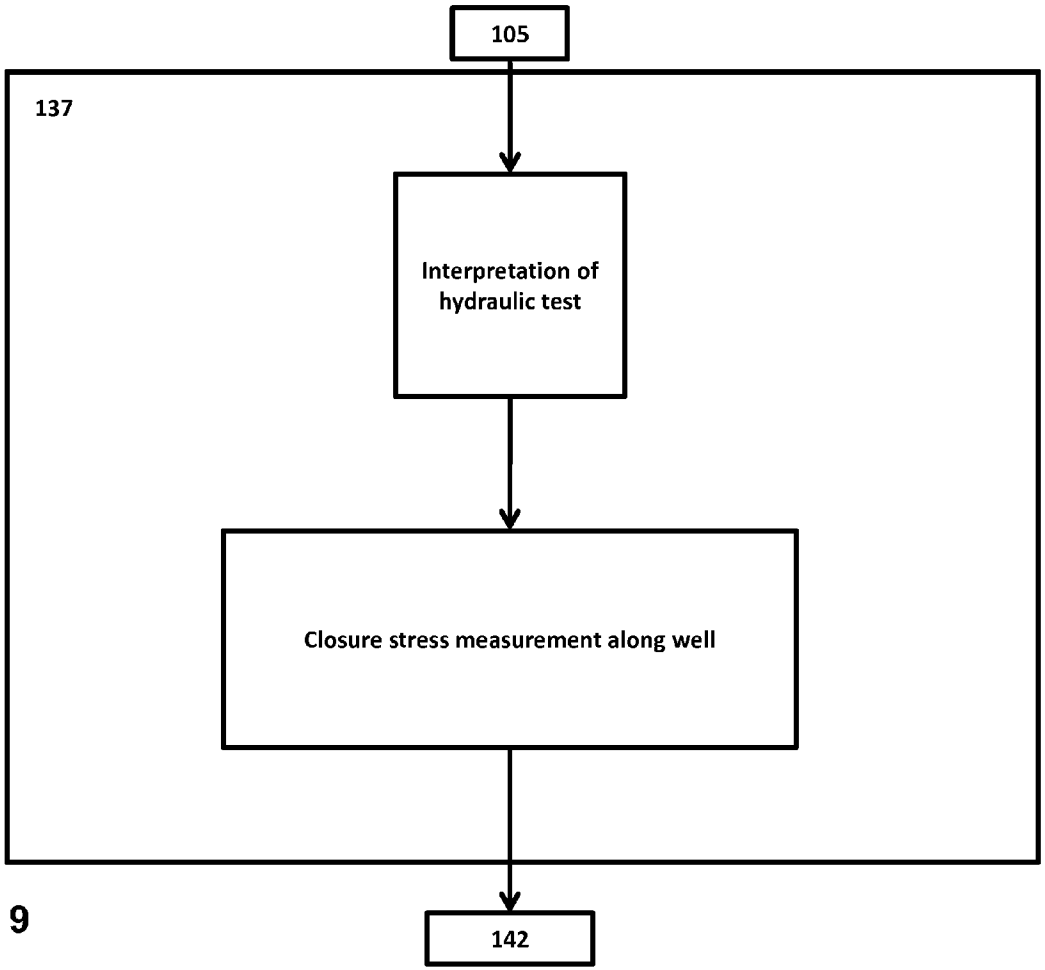
FIG. 9 is a flow chart illustrating closure stress analysis.

This step leads to the estimation of point-wise closure stress measurements where the tests are performed. For example, FIG. 9 is a flow chart of one embodiment of step 137. The hydraulic test is interpreted, then closure stress is measured along the well. This is combined for completion quality data step 142.

Reservoir Quality and Completion Quality

Box 141: Reservoir Quality (RQ) Data

This step 141 includes both the graphical display of all data collected in steps 131-132-133-134 as function of the depth of the well and the computation and display of the "Reservoir Quality (RQ)" index. Data from steps 131-132-133-134 include volume, type and isotope distribution of gas, weight or volume fraction of inorganic minerals and organic kerogen (with or without maturity), pore volume, surface area, porosity and gamma (LWD GR and measured on cuttings). One way to compute the RQ index would be to create either a piece-wise constant property log using a blocking algorithm where cut-off conditions are defined for each properties or a composite log using a weighted score algorithm from the multiple input logs. The output of such computation is binary "good/bad" RQ index.

Box 142: Completion Quality (CQ) Data

This step 142 includes both the graphical display of all data collected in steps 135-136-137 as function of the depth of the well and the computation of "Completion Quality (CQ)" index. Data from steps 135-136-137 include the 2 to 5 elastic moduli, rock strength, and closure stress. Based on the elasticity data and closure data, a closure stress index can be computed [M. J. Thiercelin, SPE, and R. A. Plumb, 1994, A Core-Based Prediction of Lithologic Stress Contrasts in East Texas Formations, SPE Formation Evaluation, Volume 9, Number 4, Society of Petroleum Engineers 21847; George A. Waters, Richard E. Lewis and Doug C. Bentley, 2011, The Effect of Mechanical Properties Anisotropy in the Generation of Hydraulic Fractures in Organic Shales, SPE Annual Technical Conference and Exhibition, 30 Oct.-2 Nov. 2011, Denver, Colo., USA, Society of Petroleum Engineers 146776.]. One way to compute the CQ index would be to create either a piece-wise constant property log using a blocking algorithm where cut-off conditions are defined for each properties or a composite log using a weighted score algorithm from the multiple input logs. The output of such computation is binary "good/bad" CQ index.

Box 151: Selective Staging of Hydraulic Fractures From RQ and CQ Index

This step includes both the graphical display of all information from steps 141-142 and an algorithm that optimizes the number and position of fracturing stages and the number and position of perforation clusters from a stage based on RQ and CQ indexes.

Examples of such algorithms covering steps 141, 142 and 151 are given in C. Cipolla, X. Weng, H. Onda, T. Nadaraja, U. Ganguly, and R. Malpani, 2011, New Algorithms and Integrated Workflow for Tight Gas and Shale Completions, SPE Annual Technical Conference and Exhibition, 30 Oct.-2 Nov. 2011, Denver, Colo., USA, Society of Petroleum Engineers 146872 and U.S. patent application Ser. Nos. 13/338,732 and 13/338,784. These paper and patent applications are incorporated by reference herein.

Generally, characterizing the reservoir quality may include using information from a mud gas log, DRIFTS, gas sorption, XRD, XRF, natural spectral GR, NMR, drilling data, calcimetry, Raman spectroscopy, NMR Spectroscopy, cross-polarization magic angle spinning NMR, loss on ignition, hydrogen peroxide digestion, petrography, thermal alteration index, elemental analysis, wet oxidation followed by titration with ferros ammonium sulfate or photometric determination of $Cr^{3+}$, wet oxidation followed by the collection and measurement of evolved $CO_2$, dry combustion at high temperatures in a furnace with the collection and detection of evolved $CO_2$ or a combination thereof. Additional patent applications that provide additional processes, procedures, and details for the analysis of cuttings and other relevant process steps include U.S. Provisional Patent Applications Ser. Nos. 61/623,636, 61/623,646, and 61/623,694, filed on Apr. 13, 2012, all three of which are incorporated by reference herein.

U.S. patent application Ser. No. 13/446,995, filed Apr. 13, 2012, which is incorporated by reference herein includes additional details, processes and procedures that related to the processes described herein. A detailed analysis of TOC characterization may be obtained from "Methods for the Determination of Total Organic Carbon (TOC) in Soils and sediments by Brian A. Schumacher of the United States Environmental Protection Agency Ecological Risk Assessment Support Center NCEA-C-1282, EMASC-001, April 2002, which is incorporated by reference herein.

Additional Advantages

Embodiments of the invention may benefit from near real time geosteering, a characterization guide completion job with a short time requirement, and characterization that happens over time that may be used for reservoir modeling, such as clay identification, refracturing planning, and well remediation for casing issues. One embodiment enables the assessment of reservoir and completion quality of an unconventional shale gas reservoir, by integrating information from a mud-gas log, drill-bit cuttings and drilling data. The basic driver is to create a practical and efficient solution to obtain the needed data to design a completion job (hydraulic fracturing), in the absence of wireline or LWD well logs and/or core data. The data from old wells can also be used later for better reservoir modeling and management. Data from these three components can be integrated, without any logs or core data, to assess reservoir and completion quality.

One embodiment proposes a solution that satisfies all the above criteria, by combining a mud-gas log, organic and inorganic formation properties obtained from cuttings, and geomechanical data derived from drilling data to help design a completion program that optimizes the resources available and potential production. The data is collected over discrete intervals, depending on drilling speed and available resources, typically in 30 to 90 foot windows.

While the intended target for some embodiments is horizontal wells, vertical wells may also benefit from techniques described above. Furthermore, the data acquired previously can later be analyzed in post-mortem mode, to investigate production anomalies or other inconsistencies, among wells already drilled and are producing.

The oil field service may be selected from the group consisting of drilling hydraulic fracturing, geosteering, perforation and a combination thereof.

Time and location are important considerations for embodiments of this procedure. The analyzing occurs in less than an hour and/or in less than 24 hours in some embodiments. The analyzing occurs before recovering hydrocarbons begins in some embodiments or after producing hydrocarbons begins in some embodiments. The analyzing may occur during reservoir characterization during production. Some embodiments may use equipment within 500 meters of a wellbore. In some embodiments, analyzing occurs while drilling the formation.

We claim:

1. A method for drilling a subterranean wellbore, the method comprising:

(a) drilling the subterranean wellbore;

(b) analyzing hydrocarbon gases acquired while drilling in (a) to obtain a log of hydrocarbon gas content and composition;

(c) analyzing formation cuttings acquired while drilling in (a) to obtain a chemical composition of the cuttings, the chemical composition including at least one of a mineralogy of the cuttings, a kerogen content, and a kerogen maturity;

(d) analyzing the formation cuttings acquired while drilling in (a) to obtain an estimate of surface area and pore volume of the formation cuttings;

(e) analyzing the formation cuttings acquired while drilling in (a) to obtain elastic properties of the formation cuttings;

(f) processing the log obtained in (b), the chemical composition of the cuttings obtained in (c), and the estimate of surface area and pore volume of the formation cuttings obtained in (d) to compute a reservoir quality index;

(g) processing the elastic properties of the formation cuttings obtained in (e) to compute a completion quality index;

(h) processing the reservoir quality index computed in (f) and the completion quality index computed in (g) to compute a number and position of fracturing stages for the subterranean wellbore.

2. The method of claim 1, further comprising comparing gamma ray logging data acquired while drilling in (a) with gamma ray data acquired for the formation cuttings to evaluate cuttings depth.

3. The method of claim 2, wherein the comparing comprises depth matching to obtain a depth for the formation cuttings.

4. The method of claim 1, further comprising:

(i) executing a stimulation at one of the positions computed in (h).

5. The method of claim 1, wherein the the analyzing in (b), (c), and (d) comprises processing data obtained using at least one of the following: a mud gas log, Diffuse Reflectance Infrared Fourier Transform Spectroscopy, gas sorption, X-Ray Diffraction, X-Ray Fluorescence, natural spectral gamma ray, Nuclear Magnetic Resonance (NMR), drilling data, calcimetry, Raman spectroscopy, NMR Spectroscopy, cross-polarization magic angle spinning NMR, loss on ignition, hydrogen peroxide digestion, petrography, thermal alteration index, elemental analysis, wet oxidation followed by titration with ferros ammonium sulfate or photometric determination of $Cr^{3+}$, wet oxidation followed by the collection and measurement of evolved $CO_2$, dry combustion at high temperatures in a furnace with the collection and detection of evolved $CO_2$, and combinations thereof.

6. The method of claim 1, wherein the analyzing in (c) comprises combining X-Ray Fluorescence and X Ray Diffraction data.

7. The method of claim 1, wherein the analyzing in (c) comprises combining X-Ray Diffraction and Fourier Transform Infrared Spectroscopy data.

8. The method of claim 1, wherein the analyzing in (c) comprises combining Fourier Transform Infrared Spectroscopy and X-Ray Fluorescence data.

9. The method of claim 8, wherein the analyzing in (c) comprises combining the Fourier Transform Infrared Spectroscopy and X-Ray Fluorescence data with X-Ray Diffraction data.

10. The method of claim 1, wherein the analyzing in (c) comprises combining Raman spectroscopy and X-Ray Fluorescence data.

11. The method of claim 10, wherein the analyzing in (c) comprises combining the Raman Spectroscopy and X-Ray Fluorescence data with X-Ray Diffraction data.

12. The method of claim 1, wherein the analyzing in (c) comprises combining Raman spectroscopy and X-Ray Diffraction data.

13. The method of claim 1, wherein the analyzing in (c) comprises combining Raman spectroscopy, X-Ray Fluorescence, and Fourier Transform Infrared Spectroscopy data.

14. The method of claim 13, wherein the analyzing in (c) comprises combining the Raman spectroscopy, X-Ray Fluorescence, and Fourier Transform Infrared Spectroscopy data with X-Ray Diffraction data.

15. The method of claim 1, wherein the analyzing in (c) comprises combining Raman spectroscopy, X-Ray Diffraction, and Fourier Transform Infrared Spectroscopy data.

16. The method of claim 1, wherein the analyzing in (c) comprises obtaining mineralogy, total organic carbon, and kerogen maturity from Fourier Transform Infrared Spectroscopy and X-Ray Diffraction data.

17. The method of claim 1, wherein the analyzing in (c) comprises obtaining mineralogy, total organic carbon, and kerogen maturity from X-Ray Fluorescence and X-Ray Diffraction data.

18. The method of claim 1, wherein the completion quality consists of information from the group consisting of mineralogy and a rock physics model, data manipulation of the drilling data, leak-off tests and a combination thereof.

19. The method of claim 1, wherein the reservoir quality comprises gas properties, mineralogy, kerogen content and maturity, gas sorption, pore volume, porosity.

20. The method of claim 1, wherein the formation cuttings are exposed to a cleaning fluid prior to the analyzing (c), (d), and (e).

21. The method of claim 20, wherein the cleaning fluid is selected from the group consisting of drilling fluid base oil, pentane, hexane, heptane, acetone, toluene, benzene, xylene, chloroform, dichloromethane, surfactant, and a combination thereof.

22. The method of claim 1, wherein the processing in (h) occurs before recovering hydrocarbons begins.

23. The method of claim 1, wherein the analyzing in (b), (c), (d), and (e), and the processing in (f), (g), and (h) occur within 500 meters of the wellbore being drilled (a).

24. The method of claim 1, wherein the analyzing in (b), (c), (d), and (e), and the processing in (f), (g), and (h) occur with no sensors receiving, transmitting, or collecting data in the wellbore being drilled (a).

25. The method of claim 1, wherein the analyzing in (b), (c), (d), and (e), and the processing in (f), (g), and (h) occur in less than 24 hours.

26. The method of claim 1, wherein the analyzing in (b) comprises at least one of gas chromatograph or a gas chromatograph/mass spectrometer measurement.

27. The method of claim 1, further comprising acquiring drilling operation data;

analyzing the drilling operation data for intrinsic specific energy and rock strength; and wherein the processing in (g) further comprises processing the intrinsic specific energy and rock strength to obtain the completion quality.

28. The method of claim 1, further comprising acquiring wellbore pressure measurements;

analyzing the wellbore pressure measurements for closures stress; and wherein the processing in (g) further comprises processing the closure stress to obtain the completion quality.

29. The method of claim 1, further comprising acquiring drilling operation data, and wellbore pressure measurements;

analyzing the drilling operation data for intrinsic specific energy and rock strength;

analyzing the wellbore pressure measurements for closures stress; and wherein the processing in (g) further comprises processing the intrinsic specific energy and rock strength and the closure stress to obtain the completion quality.

* * * * *